US010883209B2

(12) United States Patent
Kongo

(10) Patent No.: US 10,883,209 B2
(45) Date of Patent: Jan. 5, 2021

(54) EMBROIDERY SEWING MACHINE, SEWING METHOD, AND PROGRAM

(71) Applicant: JANOME SEWING MACHINE CO., LTD., Tokyo (JP)

(72) Inventor: Takeshi Kongo, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 470 days.

(21) Appl. No.: 15/956,818

(22) Filed: Apr. 19, 2018

(65) Prior Publication Data

US 2018/0371659 A1 Dec. 27, 2018

(30) Foreign Application Priority Data

Jun. 26, 2017 (JP) ..... 2017-124683

(51) Int. Cl.

| | |
|---|---|
| ***D05B 19/08*** | (2006.01) |
| ***D05C 13/02*** | (2006.01) |
| ***D05C 3/02*** | (2006.01) |
| ***D05B 19/10*** | (2006.01) |
| ***D05B 3/02*** | (2006.01) |
| ***D05C 5/02*** | (2006.01) |

(52) U.S. Cl.

CPC ..... *D05B 19/08* (2013.01); *D05B 3/02* (2013.01); *D05B 19/10* (2013.01); *D05C 3/02* (2013.01); *D05C 5/02* (2013.01); *D05C 13/02* (2013.01); *D05D 2305/32* (2013.01)

(58) Field of Classification Search

CPC ..... D05B 19/00; D05B 19/02; D05B 19/09; D05B 19/18; D05B 19/08

See application file for complete search history.

(56) References Cited

U.S. PATENT DOCUMENTS 4,664,047 A * 5/1987 Sano ..... D05B 19/02 112/454
4,962,715 A * 10/1990 Hyodo ..... D05B 19/02 112/316
5,379,226 A * 1/1995 Shigeta ..... D05B 19/08 112/102.5

(Continued)

FOREIGN PATENT DOCUMENTS

JP H04-89087 A 3/1992

*Primary Examiner* — Tajash D Patel

(74) *Attorney, Agent, or Firm* — Nakanishi IP Associates, LLC

(57) ABSTRACT

An embroidery sewing machine calculates the number of designs to be used for sewing for a length that is closest to a desired sewing length, based on the desired sewing length and information regarding the designs. The embroidery sewing machine calculates the sewing length based on the calculated number of designs and the information regarding the designs. Furthermore, the embroidery sewing machine adjusts the length of each design such that the calculated sewing length matches the desired sewing length, and converts the adjusted data of the designs into embroidery data. This enables sewing such that the sewing start and end points match each other or junction matching is secured, even in a case of sewing in the form of various kinds of combinations of curves and lines or the like. In addition, this provides an embroidery sewing machine that is capable of executing sewing with an improved appearance.

14 Claims, 21 Drawing Sheets

(56) References Cited

U.S. PATENT DOCUMENTS

| | | | | |
|---|---|---|---|---|
| 2008/0289553 | A1* | 11/2008 | Yamada | D05B 19/08<br>112/470.04 |
| 2013/0186316 | A1* | 7/2013 | Mizuno | D05B 19/10<br>112/102.5 |
| 2019/0024276 | A1* | 1/2019 | Nguyen | G05B 19/4097 |

* cited by examiner

| STITCH NUMBER | SWING AMOUNT | RELATIVE FEED AMOUNT | ABSOLUTE FEED AMOUNT |
|---|---|---|---|
| 1 | 0.0 | 0.0 | 0.0 |
| 2 | 0.0 | 1.0 | 1.0 |
| 3 | 2.0 | 2.0 | 3.0 |
| 4 | 4.5 | 0.0 | 3.0 |
| 5 | 3.0 | −2.0 | 1.0 |
| 6 | 0.0 | 0.4 | 1.4 |
| 7 | 0.0 | 1.2 | 2.6 |
| 8 | −2.0 | 2.4 | 5.0 |
| 9 | −4.5 | 0.0 | 5.0 |
| 10 | −3.0 | −2.0 | 3.0 |
| 11 | 0.0 | 0.0 | 3.0 |
| 12 | 0.0 | 1.6 | 4.6 |
| INTERVAL | | 1.4mm | |
| 1 | 0.0 | 0.0 | 6.0+0.0 |
| 2 | 0.0 | 1.0 | 6.0+1.0 |
| | | | |
| 10 | −3.0 | −2.0 | 6.0+3.0 |
| 11 | 0.0 | 0.0 | 6.0+3.0 |
| 12 | 0.0 | 1.6 | 6.0+4.6 |
| INTERVAL | | 1.4mm | |
| 1 | 0.0 | 0.0 | 12.0+0.0 |
| 2 | 0.0 | 1.0 | 12.0+1.0 |
| 3 | 2.0 | 2.0 | 12.0+3.0 |
| | | | |
| 10 | −3.0 | −2.0 | 12.0+3.0 |
| 11 | 0.0 | 0.0 | 12.0+3.0 |
| 12 | 0.0 | 1.6 | 12.0+4.6 |
| INTERVAL | | 1.4mm | |
| 1 | 0.0 | 0.0 | 12.0+6.0 |
| ... | | | |

FIG.5

| STITCH NUMBER | Xmm | Ymm |
|---|---|---|
| 1 | 50.0 | 0.00 |
| 2 | 49.99 | −1.00 |
| 3 | 51.91 | −3.12 |
| 4 | 54.40 | −3.27 |
| 5 | 52.99 | −1.06 |
| 6 | 49.98 | −1.40 |
| 7 | 49.93 | −2.60 |
| 8 | 47.76 | −4.79 |
| 9 | 45.27 | −4.54 |
| 10 | 46.29 | −2.82 |
| 11 | 49.91 | −3.00 |
| 12 | 49.79 | −4.59 |
| INTERVAL | | |
| 1 | 49.64 | −5.99 |
| 2 | 49.51 | −6.98 |
| | ⋮ | ⋮ |
| 10 | 46.24 | −8.41 |
| 11 | 49.19 | −8.95 |
| 12 | 48.88 | −10.52 |
| INTERVAL | | |
| 1 | 48.57 | −11.89 |
| 2 | 48.32 | −12.85 |
| 3 | 49.68 | −15.37 |
| | ⋮ | ⋮ |
| 10 | 44.90 | −13.89 |
| 11 | 47.77 | −14.78 |
| 12 | 47.27 | −16.30 |
| INTERVAL | | |
| 1 | 46.79 | −17.61 |
| ... | ⋮ | ⋮ |

FIG.6

| STITCH NUMBER | Lmm | θ rad |
|---|---|---|
| 1 | 50.0 | 0.000 |
| 2 | 50.0 | 0.020 |
| 3 | 52.0 | 0.060 |
| 4 | 54.5 | 0.060 |
| 5 | 53.0 | 0.020 |
| 6 | 50.0 | 0.028 |
| 7 | 50.0 | 0.052 |
| 8 | 48.0 | 0.100 |
| 9 | 45.5 | 0.100 |
| 10 | 47.0 | 0.060 |
| 11 | 50.0 | 0.060 |
| 12 | 50.0 | 0.092 |
| INTERVAL | | +0.028 |
| 1 | 50.0 | 0.120 |
| 2 | 50.0 | 0.140 |
| | ⋮ | ⋮ |
| 10 | 47.0 | 0.180 |
| 11 | 50.0 | 0.180 |
| 12 | 50.0 | 0.212 |
| INTERVAL | | +0.028 |
| 1 | 50.0 | 0.240 |
| 2 | 50.0 | 0.260 |
| 3 | 52.0 | 0.300 |
| | ⋮ | ⋮ |
| 10 | 47.0 | 0.300 |
| 11 | 50.0 | 0.300 |
| 12 | 50.0 | 0.332 |
| INTERVAL | | +0.028 |
| 1 | 50.0 | 0.360 |
| ... | ⋮ | ⋮ |

FIG.10

| STITCH NUMBER | SWING AMOUNT | RELATIVE FEED AMOUNT | ABSOLUTE FEED AMOUNT |
|---|---|---|---|
| 1 | 0.0 | 0.0 | 0.0 |
| 2 | 0.0 | 1.0 | 1.0 |
| 3 | 2.0 | 2.0 | 3.0 |
| 4 | 4.5 | 0.0 | 3.0 |
| 5 | 3.0 | −2.0 | 1.0 |
| 6 | 0.0 | 0.4 | 1.4 |
| 7 | 0.0 | 1.2 | 2.6 |
| 8 | −2.0 | 2.4 | 5.0 |
| 9 | −4.5 | 0.0 | 5.0 |
| 10 | −3.0 | −2.0 | 3.0 |
| 11 | 0.0 | 0.0 | 3.0 |
| 12 | 0.0 | 1.6 | 4.6 |
| INTERVAL | | 1.4mm | |
| 1 | 0.0 | 0.0 | 6.0+0.0 |
| 2 | 0.0 | 1.0 | 6.0+1.0 |
| | | | |
| 10 | −3.0 | −2.0 | 6.0+3.0 |
| 11 | 0.0 | 0.0 | 6.0+3.0 |
| 12 | 0.0 | 1.6 | 6.0+4.6 |
| INTERVAL | | 1.4mm | |
| 1 | 0.0 | 0.0 | 12.0+0.0 |
| 2 | 0.0 | 1.0 | 12.0+1.0 |
| 3 | 2.0 | 2.0 | 12.0+3.0 |
| | | | |
| 10 | −3.0 | −2.0 | 12.0+3.0 |
| 11 | 0.0 | 0.0 | 12.0+3.0 |
| 12 | 0.0 | 1.6 | 12.0+4.6 |
| INTERVAL | | 1.4mm | |
| 1 | 0.0 | 0.0 | 12.0+6.0 |
| ... | | | |

FIG.15

| STITCH NUMBER | Xmm | Ymm |
|---|---|---|
| 1 | 0.0 | 0.0 |
| 2 | 1.0 | 0.0 |
| 3 | 3.0 | 2.0 |
| 4 | 3.0 | 4.5 |
| 5 | 1.0 | 3.0 |
| 6 | 1.4 | 0.0 |
| 7 | 2.6 | 0.0 |
| 8 | 5.0 | −2.0 |
| 9 | 5.0 | −4.5 |
| 10 | 3.0 | −3.0 |
| 11 | 3.0 | 0.0 |
| 12 | 4.6 | 0.0 |
| INTERVAL | | |
| 1 | 6.0 | 0.0 |
| 2 | 7.0 | 0.0 |
| | ⋮ | ⋮ |
| 10 | 9.0 | −3.0 |
| 11 | 9.0 | 0.0 |
| 12 | 10.6 | 0.0 |
| INTERVAL | | |
| 1 | 12.0 | 0.0 |
| 2 | 13.0 | 0.0 |
| 3 | 15.0 | 2.0 |
| | ⋮ | ⋮ |
| 10 | 15.0 | −3.0 |
| 11 | 15.0 | 0.0 |
| 12 | 16.6 | 0.0 |
| INTERVAL | | |
| 1 | 18.0 | 0.0 |
| ... | ⋮ | ⋮ |

FIG.16

EMBROIDERY SEWING MACHINE, SEWING METHOD, AND PROGRAM

BACKGROUND OF THE INVENTION

1. Field of the Invention

The present invention relates to an embroidery sewing machine, a sewing method, and a program.

2. Description of the Related Art

As ordinary sewing functions, a circular sewing function, a ruler work function, and the like are known. Circular sewing is a sewing method for repeatedly forming a unit of a sewing design along a circle using a circular attachment. In this method, a particular point on a cloth is fixed by means of a pin such that the distance between this particular point and a needle, a thread, and a feed dog, which are to be used to form a stitching pattern, is set to the circular sewing radius. In this state, the cloth is forcibly fed by means of the feed dog, thereby providing a design along the circle.

However, this method has a problem in that, in many cases, the circular sewing start point does not match the circular sewing end point. In addition, in this method, a cloth is forcibly turned in a state in which the cloth is fixed by means of a pin. This leads to a large opening at a position at which the needle is inserted, resulting in a problem of a poor appearance after sewing or the like. In particular, in a case in which such an opening is formed in leather, vinyl, or the like, this leads to a problem of poor appearance after sewing. On the other hand, in ruler work, a sewing pattern is formed along the outline of a ruler in a state in which a dedicated foot is pressed into contact with the dedicated ruler. However, the operation of the needle is limited to only a region between the needle and the outer edge of the ruler used in the ruler work. Accordingly, the region in which the ruler work is capable of providing a unit of a sewing design is limited to only a region outside the ruler. Ideally, a design is preferably formed so as to have a swing width that is orthogonal to a region where the ruler is pressed in contact. In actuality, the cloth is fed along the longitudinal direction of the ruler. Accordingly, the ruler work provides a design having a swing width that is orthogonal to the feeding direction. That is to say, a design cannot be formed according to the shape of the ruler. This leads to a problem of deformation of the design.

In order to solve such problems as described above, a technique has been disclosed. In this technique, the circular length is calculated based on the distance between the needle center and the pinning point on the cloth (circular sewing radius), and the circular length thus calculated is divided by the length of a selected design. In a case in which the division result cannot be represented by an integer, the length is adjusted for at least one of the designs so as to absorb the excess or deficiency, thereby allowing the sewing start point to match the sewing end point. Also, as another technique, with a circular sewing apparatus configured to allow the user to pin a particular point on a cloth by inserting a pin into any one of multiple openings formed in a needle plate, and configured to repeatedly form a design selected via a design selection switch along a circle with the distance between the pinning point and the needle center as the radius thereof, when the pin is inserted into any one of the aforementioned multiple openings, the distance between the center of the needle and the pinning point on the cloth, i.e., the circular sewing radius, is detected, and the length of the circle is calculated based on the radius thus detected. Subsequently, the length of the design selected via the design selection switch is detected, and the length of the circle thus calculated is divided by the length of the design. In a case in which the division result cannot be represented by an integer, the number of designs for which the length is to be adjusted and length adjustment data are calculated so as to absorb the excess or deficiency, thereby allowing the sewing start point and the sewing end point to match each other in the circular sewing (see Patent document 1, for example).

RELATED ART DOCUMENTS

Patent Documents

[Patent Document 1]

Japanese Patent Application Laid Open No. H04-89087

However, even in a case of employing the technique disclosed in Patent document 1, a constant cloth-feeding efficiency cannot be provided due to an already-formed stitching pattern, a situation of the cloth, a difference in placement of the user's hand on the cloth, etc. Accordingly, such a technique does not offer a complete solution that allows the sewing start point and the sewing end point to match each other in the circular sewing. Also, in this method, the cloth is fixedly mounted by means of a pin as with conventional techniques. Accordingly, this method leads to a problem of a large opening formed at a pinning point. This leads to a lack of resolution of a problem such as a damaged appearance after sewing. Also, in a case of performing the ruler work, the operation of the needle is limited to a region between the needle and the outer edge of the ruler used in the ruler work. Accordingly, this technique is by no means capable of providing any solution for solving a problem in that the region in which a design can be formed by the ruler work is limited to only a region outside the ruler.

SUMMARY OF THE INVENTION

Accordingly, one or more embodiments of the present invention to provide an embroidery sewing machine configured to allow a sewing operation to be performed with the sewing start point matching the sewing end point or otherwise the sewing junction, and to be capable of executing a sewing operation with an improved appearance.

Embodiment 1

At least one embodiment of the present invention proposes an embroidery sewing machine configured to perform sewing of multiple designs arranged for a desired sewing length. The embroidery sewing machine comprises: a storage unit that stores the desired sewing length and information with respect to the designs; a cycle number calculation unit that calculates a number of designs to be used for sewing for a length that is closest to the desired sewing length, based on the desired sewing length and the information with respect to the designs; a sewing length calculation unit that calculates a sewing length based on the number of the designs calculated by the cycle number calculation unit and the information with respect to the designs; an adjustment unit that adjusts the length of the designs such that the desired sewing length matches the calculated sewing length; and a data conversion unit that converts data of the designs that support the sewing length thus adjusted into embroidery data.

Embodiment 2

At least one embodiment the present invention also proposes the embroidery sewing machine. The aforementioned design is formed of an actual design portion having a predetermined shape and an actual design junction portion that joins adjacent actual design portions, arranged in a region defined in a length direction and a width direction that is orthogonal to the length direction. The adjustment unit adjusts one from among or otherwise both of a length of the actual design portion and a length of the actual design junction portion.

Embodiment 3

At least one embodiment of the present invention also proposes the embroidery sewing machine. In a case of adjusting the length of the actual design portion, the adjustment unit subtracts a length of the actual design junction portions that corresponds to the number of the designs thus calculated from the desired sewing length. The adjustment unit divides the length thus subjected to the subtraction by a value obtained by multiplying the number of designs thus calculated by the length of the actual design portion, so as to calculate a scaling factor to be applied to the length of the actual design portion. The adjustment unit adjusts the length of the actual design portion using the scaling factor thus calculated.

Embodiment 4

At least one embodiment of the present invention also proposes the embroidery sewing machine. In a case of adjusting the length of the actual design junction portion, the adjustment unit subtracts a length of the actual design portions that corresponds to the number of the designs thus calculated from the desired sewing length. The adjustment unit divides the length thus subjected to the subtraction by a value obtained by multiplying the number of designs thus calculated by the length of the actual design junction portion, so as to calculate a scaling factor to be applied to the length of the actual design junction portion. The adjustment unit adjusts the length of the actual design junction portion using the scaling factor thus calculated.

Embodiment 5

At least one embodiment of the present invention also proposes the embroidery sewing machine. The adjustment unit subtracts a length of the actual design junction portions that corresponds to the number of the designs thus calculated from the desired sewing length. The adjustment unit divides the length thus subjected to the subtraction by a value obtained by multiplying the number of designs thus calculated by the length of the actual design portion, so as to calculate a scaling factor to be applied to the length of the actual design portion. The adjustment unit subtracts a length of the actual design portions that corresponds to the number of the designs thus calculated from the desired sewing length. The adjustment unit divides the length thus subjected to the subtraction by a value obtained by multiplying the number of designs thus calculated by the length of the actual design junction portion, so as to calculate a scaling factor to be applied to the length of the actual design junction portion. The adjustment unit selects, from among the scaling factor for the length of the actual design portion and the scaling factor for the length of the actual design junction portion, a scaling factor that closer to 1, and performs adjustment based on the selected scaling factor.

Embodiment 6

At least one embodiment of the present invention also proposes the embroidery sewing machine. The adjustment unit calculates an adjustment scaling factor to be used for sewing of multiple designs arranged for a desired sewing length, in order to perform adjustment such that the desired sewing length matches the sewing length thus calculated based on the length of the actual design portion and the length of the actual design junction portion.

Embodiment 7

At least one embodiment of the present invention also proposes the embroidery sewing machine. In a case in which the designs are arranged along a curve, the data conversion unit converts the data of the designs thus adjusted into polar coordinate data, following which the data conversion unit converts the polar coordinate data into the embroidery data.

Embodiment 8

At least one embodiment of the present invention also proposes the embroidery sewing machine. The data conversion unit comprises: a circle information calculation unit that calculates a radius and a coordinate position of a center of a circle defined such that three points, including an arbitrary point along the curve on which the designs are arranged and two points before and after the arbitrary point, are on the circumference thereof; and a polar coordinate data generating unit that generates the polar coordinate data based on a feed amount and a swing amount in sewing, the radius and the coordinate position of the center thus calculated, and the coordinate position of the arbitrary point.

Embodiment 9

At least one embodiment of the present invention also proposes the embroidery sewing machine in which multiple designs are arranged on a circle.

Embodiment 10

At least one embodiment of the present invention also proposes the embroidery sewing machine in which multiple multiple line segment lengths are defined as a desired sewing length along which the multiple designs are arranged.

Embodiment 11

At least one embodiment of the present invention also proposes the embroidery sewing machine in which multiple line segment lengths and curve lengths are defined as a desired sewing length along which the multiple designs are arranged.

Embodiment 12

At least one embodiment of the present invention also proposes the embroidery sewing machine in which multiple curve lengths are defined as a desired sewing length along which the multiple designs are arranged.

Embodiment 13

At least one embodiment of the present invention proposes a sewing method employed in an embroidery sewing machine. The embroidery sewing machine comprises a storage unit, a cycle number calculation unit, a sewing length calculation unit, an adjustment unit, and a data conversion unit, and is configured to perform sewing of multiple designs arranged for a desired sewing length. The sewing method comprises: a first step in which the cycle number calculation unit calculates a number of the designs to be used for sewing for a length that is closest to the desired sewing length, based on information with respect to the sewing of the desired sewing length and the information with respect to the designs stored in the storage unit; a second step in which the sewing length calculation unit calculates a sewing length based on the number of the designs calculated in the first step and the information with respect to the designs; a third step in which the adjustment unit adjusts the length of the designs such that the desired sewing length matches the calculated sewing length; and a fourth step in which the data conversion unit converts data of the designs that support the sewing length thus adjusted into embroidery data.

Embodiment 14

At least one embodiment of the present invention proposes a non-transitory recording medium that stores a program to be used to instruct a computer to execute a sewing method employed in an embroidery sewing machine. The embroidery sewing machine comprises a storage unit, a cycle number calculation unit, a sewing length calculation unit, an adjustment unit, and a data conversion unit, and is configured to perform sewing of multiple designs arranged for a desired sewing length. The sewing method comprises: a first step in which the cycle number calculation unit calculates a number of the designs to be used for sewing for a length that is closest to the desired sewing length, based on information with respect to the sewing of the desired sewing length and the information with respect to the designs stored in the storage unit; a second step in which the sewing length calculation unit calculates a sewing length based on the number of the designs calculated in the first step and the information with respect to the designs; a third step in which the adjustment unit adjusts the length of the designs such that the desired sewing length matches the calculated sewing length; and a fourth step in which the data conversion unit converts data of the designs that support the sewing length thus adjusted into embroidery data.

Advantage of the Present Invention

With at least one embodiment of the present invention, this arrangement allows sewing to be performed such that the sewing start and end points match each other or junction matching secured, even in a case in which sewing is performed in the form of various kinds of combinations of curves and lines or the like, in addition to a case in which sewing is performed in the form of a circle. Furthermore, this arrangement provides an advantage of executing sewing with an improved appearance.

BRIEF DESCRIPTION OF THE DRAWINGS

FIG. 5 is a diagram showing the ordinary sewing data represented in an absolute coordinate system according to the first embodiment of the present invention.

FIG. 6 is a diagram showing a data table of embroidery data defined in an orthogonal coordinate system, which is converted from the ordinary sewing data represented in the absolute coordinate system according to the first embodiment of the present invention.

FIG. 3 is a diagram showing a main electrical configuration of the embroidery sewing machine according to a second embodiment of the present invention.

FIG. 10 is a diagram showing ordinary sewing data represented in a polar coordinate system according to the second embodiment of the present invention.

FIG. 15 is a diagram showing ordinary sewing data represented in an absolute coordinate system according to a third embodiment of the present invention.

FIG. 16 is a diagram showing a data table of embroidery data defined in an orthogonal coordinate system converted from ordinary sewing data represented in an absolute coordinate system according to the third embodiment of the present invention.

DESCRIPTION OF THE PREFERRED EMBODIMENTS

Detailed description will be made with reference to FIGS. 1 through 19 regarding embodiments of the present invention.

First Embodiment

Description will be made with reference to FIGS. 1 through 7 regarding an embroidery sewing machine 10 according to the present embodiment.

[Main Configuration of Embroidery Sewing Machine]

Figure 1:
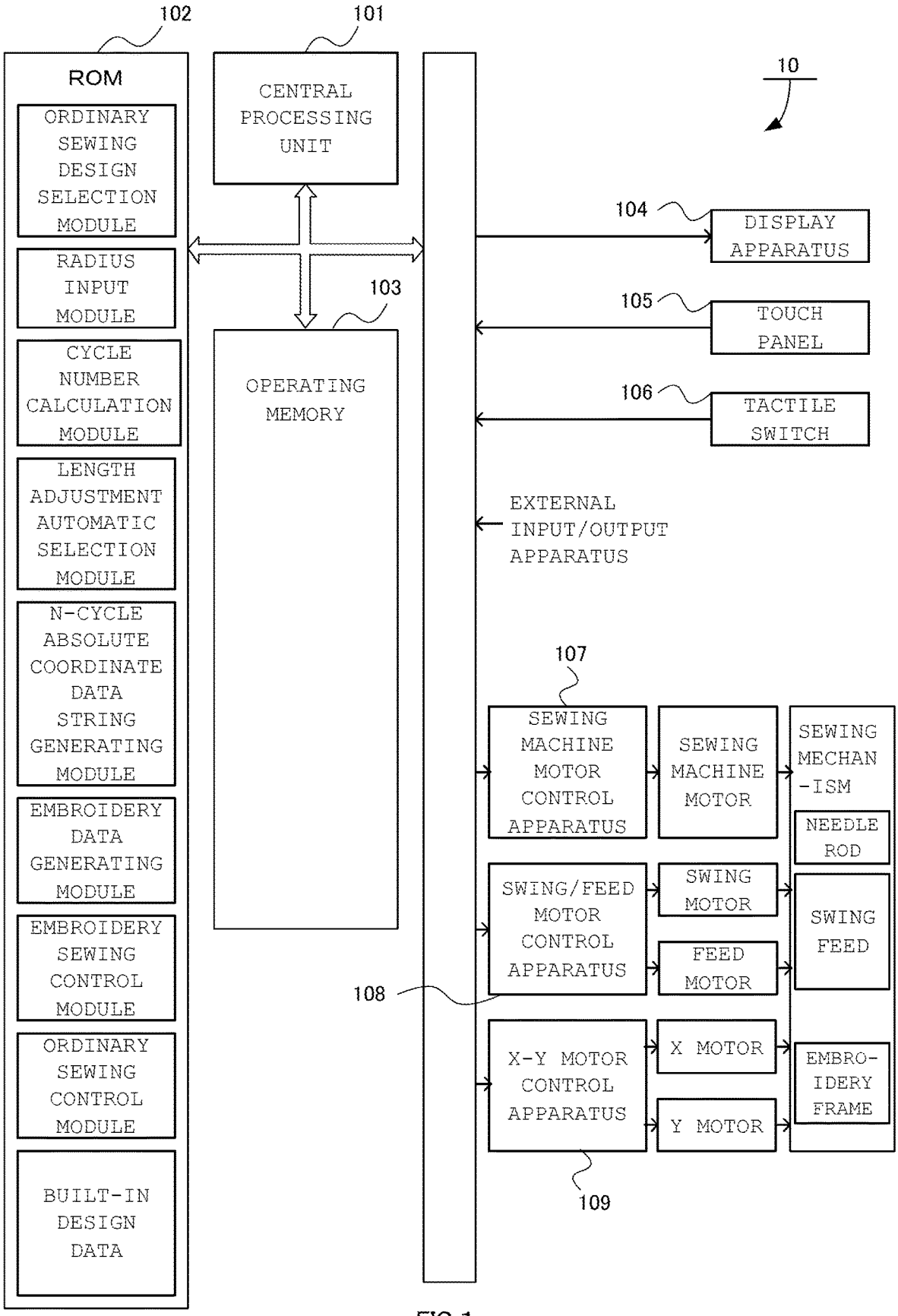
FIG. 1 is a diagram showing a main configuration of an embroidery sewing machine according to a first embodiment of the present invention.

As shown in FIG. 1, the embroidery sewing machine 10 according to the present embodiment is configured including a central processing unit (CPU) 101, ROM 102, operating memory (RAM) 103, a display apparatus 104, a touch panel 105, a tactile switch 106, a sewing machine motor control apparatus 107, a swing/feed motor control apparatus 108, and an X-Y motor control apparatus 109.

The CPU 101 controls the overall operation of the embroidery sewing machine 10 according to a control program stored in the ROM 102. The CPU 101 is connected to various kinds of devices via an external input/output apparatus. The ROM 102 and the RAM 103 each function as a storage unit that stores function modules. The ROM 102 stores various kinds of function modules and data such as an ordinary sewing design selection module, a radius input module, a cycle number calculation module, an automatic length adjustment selection module, an N-cycle absolute coordinate data string generating module, an embroidery data generating module (orthogonal coordinate data string generating module), embroidery sewing control module, an ordinary sewing control module, a built-in design data storage area, etc.

The RAM 103 temporarily stores various kinds of function modules read out from the ROM 102. Examples of such function modules include an OS, a standard library, an ordinary sewing control module, an embroidery sewing control module, and the like. Furthermore, the RAM 103 temporarily stores and holds data to be used for the operation of the CPU 101.

The display apparatus 104 is electrically connected to the CPU 101 via the external input/output apparatus. The display apparatus 104 has a multi-layer configuration in which the touch panel 105 is arranged such that it is superimposed on the lower side of the display face as described later. The touch panel 105 and the display apparatus 104 are integrated as a single unit, i.e., as the "display unit".

The touch panel 105 is configured as a touch panel employing an electrostatic capacitance method, a resistive film method, or the like. The touch panel 105 is electrically connected to the CPU 101 via the external input/output apparatus. Furthermore, the touch panel 105 is arranged such that it is exposed to the exterior of the embroidery sewing machine 10 so as to allow the user to operate the embroidery sewing machine 10 giving consideration to convenience for the user in the operation. The user operates the touch panel 105 by touching the touch panel 105 with a finger. This allows the user to select a design, to input the radius of the circular stitch, and the like, while monitoring such an operation via the screen.

The tactile switch 106 is electrically connected to the CPU 101 via the external input/output apparatus. The tactile switch 106 is configured as a group of operation buttons such as a sewing operation start/stop button, a thread cutting button, a threading button, and the like, so as to allow the user to perform a sewing operation.

The sewing machine motor control apparatus 107 is electrically connected to the CPU 101 via an external input/output apparatus. The sewing machine control apparatus 107 controls the rotational driving operation of the sewing machine motor according to an instruction from the CPU 101. This instructs the needle rod to move in the vertical direction, thereby forming a stitching pattern.

The swing/feed motor control apparatus 108 controls and drives a swing motor according to an instruction received from the CPU 101 so as to swing the needle rod, thereby providing a zig-zag operation of the needle rod. Furthermore, the swing/feed motor control apparatus 108 controls and drives a feed motor so as to control the feed amount and direction for the sewing target. That is to say, the sewing mechanism is controlled by the sewing machine motor, the swing motor, and the feed motor, so as to form a straight-line stitching pattern, a zig-zag stitching pattern, a design stitching pattern, or the like. It should be noted that, in the following description, the sewing target represents a material that can be sewn, examples of which include a cloth, leather, vinyl, and the like.

The X-Y motor control apparatus 109 is electrically connected to the CPU 101 via the external input/output apparatus. The X-Y motor control apparatus 109 controls and drives an X motor or a Y motor according to an instruction received from the CPU 101, so as to move an embroidery frame of the sewing mechanism along the X direction or Y direction. Furthermore, the X-Y motor control apparatus 109 determines each needle location point by transmitting an instruction to the X motor and the Y motor. Subsequently, the sewing machine motor control apparatus 107 controls the sewing machine motor to move in the vertical direction. This forms an embroidery stitching pattern, thereby stitching a design.

The CPU 101 sequentially executes a program module stored in the ROM 102, so as to generate the embroidery data for a circular pattern. For example, when the user selects the sewing design data comprising the swing width value, feed amount value, and the like, after the ordinary sewing design selection module is started up, the CPU 101 performs a control operation for reading out the sewing design data and storing the data thus read out in the RAM 103. This allows the information with respect to the length of the actual design portion per cycle and the length of the actual design junction portion per cycle to be obtained based on the sewing design data. It should be noted that, in a case in which the embroidery sewing machine includes an unshown USB memory drive, the CPU 101 may read out the sewing design data from an external recording medium.

[Main Electrical Configuration of Embroidery Sewing Machine]

Figure 2:
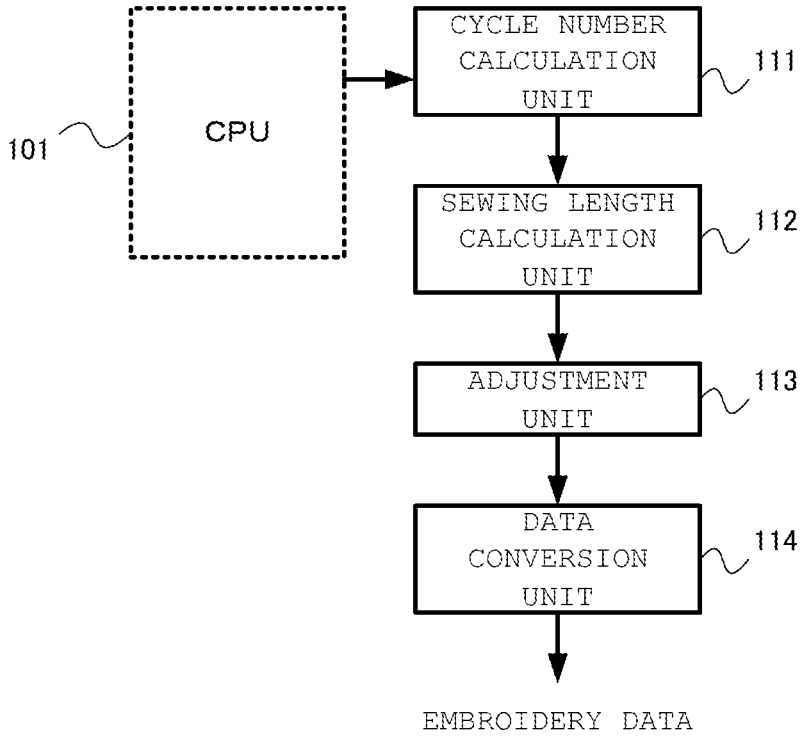
FIG. 2 is a main electrical configuration of the embroidery sewing machine according to the first embodiment of the present invention.

As shown in FIG. 2, the embroidery sewing machine 10 according to the present embodiment has a main electrical configuration including a cycle number calculation unit (cycle number calculation module) 111, a sewing length calculation unit (length adjustment automatic selection module) 112, an adjustment unit (length adjustment automatic selection module) 113, a data conversion unit (N-cycle absolute coordinate data string generating module and embroidery data generating module) 114.

The cycle number calculation unit 111 calculates, by means of the CPU 101, the number of designs to be used to perform sewing for a length that is closest to a desired sewing length, based on the information with respect to the desired length acquired from the ROM 102. It should be noted that, in this description, the "design" is formed of an actual design portion in which a predetermined pattern is formed and an actual design junction portion that joins the adjacent actual design portions.

The sewing length calculation unit 112 calculates the sewing length based on the number of designs calculated by the cycle number calculation unit 111 and the information with respect to the design. Here, the "information with respect to the design" represents the length of the design along the sewing direction, and more specifically, represents the overall length of the actual portion and the actual design junction portion of the design.

The adjustment unit 113 adjusts the length of the design such that the calculated sewing length matches a desired sewing length. The data conversion unit 114 converts the design data that supports the length of the design thus adjusted into embroidery data.

[Operation of Embroidery Sewing Machine]

Figure 3:
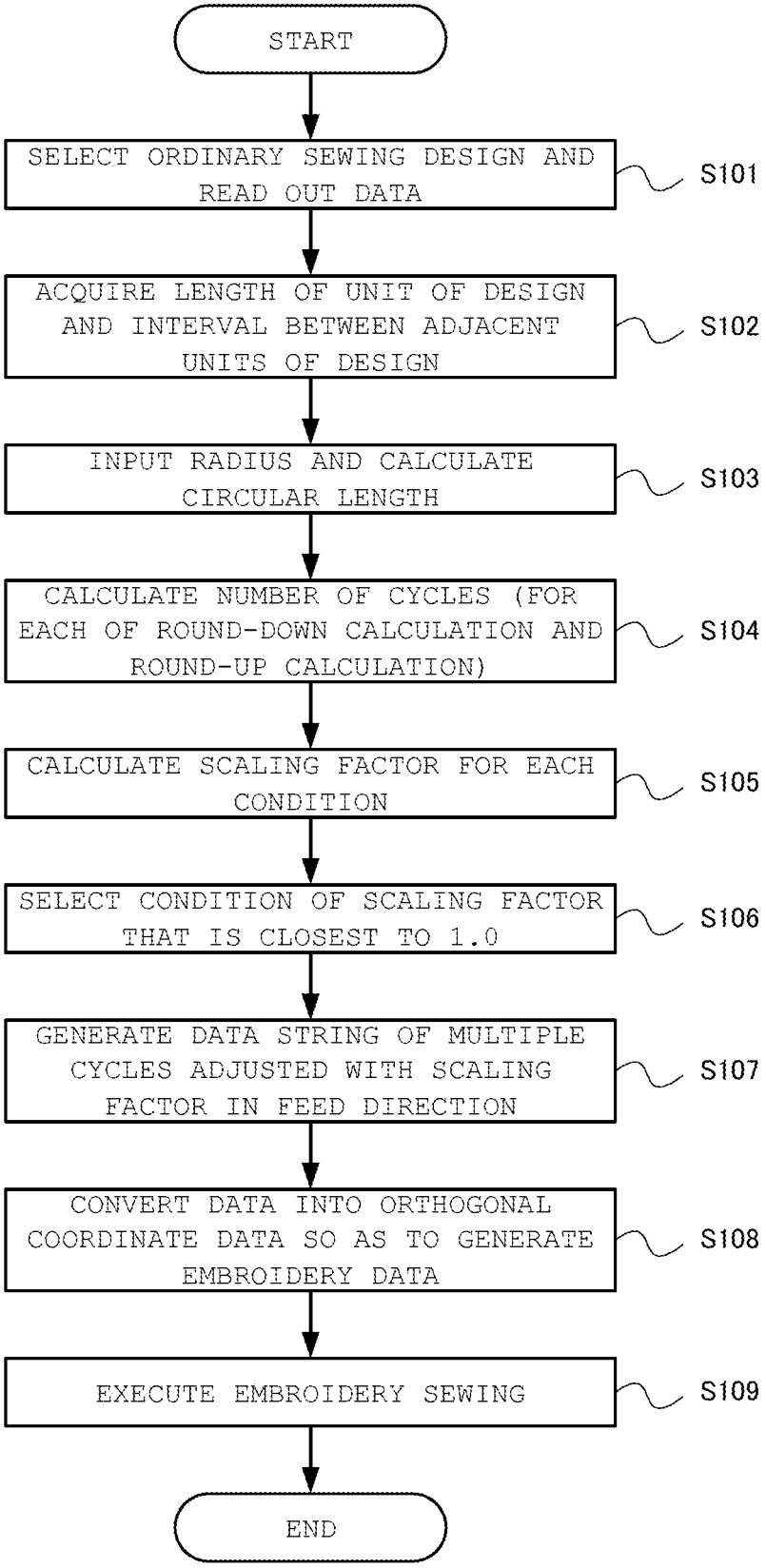
FIG. 3 is a diagram showing an operation of the embroidery sewing machine according to the first embodiment of the present invention.

Description will be made with reference to FIG. 3 regarding the operation of the embroidery sewing machine according to the present embodiment.

First, the CPU 101 instructs the display apparatus 104 to display the design data for ordinary sewing formed of the swing position data and the feed amount data in the form of an icon list that represents the built-in designs. The embroidery sewing machine allows the user to perform touch control via the touch panel 105 to select the design data for desired ordinary sewing from the displayed icon list that represents the built-in designs. The CPU 101 reads out the design data for ordinary sewing thus selected by the user, and stores the design data thus read out in the RAM 103 (Step S101).

It should be noted that, in a case in which the embroidery sewing machine includes a USB drive interface, the embroidery sewing machine may employ a method in which the design data is read out from an external recording medium.

The CPU 101 acquires the length of the actual design portion and the length of the actual design junction portion from the design data for ordinary sewing read out and stored in the RAM 103. The data of the length of the actual design portion and the length of the data of the actual design junction portion thus acquired are output to the cycle number calculation unit 111 (Step S102).

The user inputs the radius of a circular stitch to be used in the circular sewing to a predetermined input box displayed on the touch panel 105. Subsequently, the radius input module stored in the ROM 102 instructs the CPU 101 to calculate the circular length based on the radius of the circular stitch input by the user. The circular length thus calculated is output via the CPU 101 to the cycle number calculation unit 111 and the adjustment unit 113 (Step S103). It should be noted that, in a case in which the circular length of the circular stitch is a known value, the circular length may be stored beforehand in the ROM 102 or otherwise in the RAM 103.

The cycle number calculation unit 111 calculates the number of cycles based on the sewing length in the ordinary sewing data that corresponds to the input circular length, the length of the actual design portion, and the length of the actual design junction portion. Specifically, with the radius as R, with the length of the actual design portion as D, and with the length of the actual design junction portion as S, the number of cycles N is calculated based on the following Expression 1. Furthermore, the remainder Nd is calculated when the calculation result is to be rounded down, and the remainder Nu is calculated when the calculation result is to be rounded up (Step S104).

$$N=2\pi R/(D+S) \quad \text{[Expression 1]}$$

The sewing length calculation unit 112 calculates the sewing length based on the number of designs calculated by the cycle number calculation unit 111. The adjustment unit 113 calculates the scaling factor to be used to adjust the sewing length in the ordinary sewing data that corresponds to the circular length such that the sewing length matches a desired length (sewing length in the ordinary sewing data that corresponds to the circular length) (Step S105).

Specifically, the following scaling factors are calculated based on the following Expressions (1) through (4).

(1) A scaling factor kd calculated based on Expression 2 in a case in which the length of the actual design portion is to be adjusted, and with the number of cycles N calculated with the rounded-down remainder Nd.

(2) A scaling factor ku calculated based on Expression 3 in a case in which the length of the actual design portion is to be adjusted, and with the number of cycles N calculated with the rounded-up remainder Nu.

(3) A scaling factor jd calculated based on Expression in a case in which the length of the actual design junction portion is to be adjusted, and with the number of cycles N calculated with the rounded-down remainder Nd.

(4) A scaling factor ju calculated based on Expression in a case in which the length of the actual design junction portion is to be adjusted, and with the number of cycles N calculated with the rounded-up remainder Nu.

$$kd=(2\pi R-S*Nd)/(D*Nd) \quad \text{[Expression 2]}$$

$$ku=(2\pi R-S*Nu)/(D*Nu) \quad \text{[Expression 3]}$$

$$jd=(2\pi R-D*Nd)/(S*Nd) \quad \text{[Expression 4]}$$

$$ju=(2\pi R-D*Nu)/(S*Nu) \quad \text{[Expression 5]}$$

The adjustment unit 113 selects one from among kd, jd, and ju calculated in Step S105 that is closest to "1.0", and determines the selected value as an adjustment value (Step S106). It should be noted that, in a case of using a rounded-down number of cycles, the scaling factor is set to a value that is larger than "1.0", i.e., set to a scaling factor for enlargement. In a case of using a rounded-up number of cycles, the scaling factor is set to a value that is smaller than "1.0", i.e., set to a scaling factor for reduction.

Figure 4:
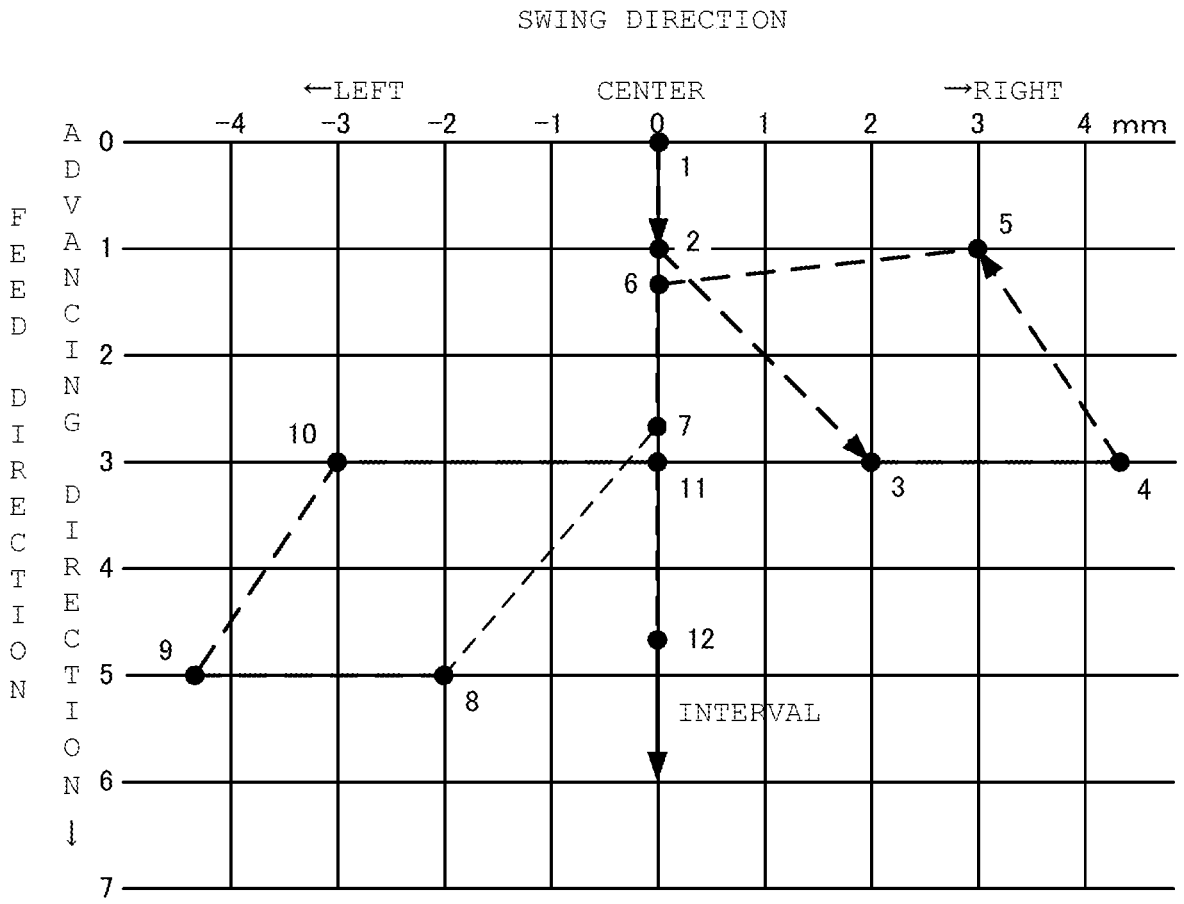
FIG. 4 is a diagram showing a data configuration for ordinary sewing according to the first embodiment of the present invention.

Here, as shown in FIG. 4, with the center in the swing direction as zero, the ordinary sewing data is formed of: swing position data that represents the swinging operation of the needle rod over a range between a leftmost position shifted by up to 4.5 mm toward the left and a rightmost position shifted by up to 4.5 mm toward the right, i.e., over a range between −4.5 mm and +4.5 mm; and relative feed data that represents the feeding operation of the feed dog over a region between −5 mm and +5 mm in which the sewing target is fed by up to 5 mm in the advancing direction or otherwise fed by up to 5 mm in the reversing direction. In this arrangement, the sewing target is moved for every stitch in the feed direction, thereby forming the actual design portion having a design length on the order of several dozen mm. The actual design portion is repeatedly and sequentially sewn, thereby providing a large-length design having multiple cycles. The sequential design can be represented by accumulating the feed data that represents the relative distance, and by further applying a space (length of the actual design junction portion) between the adjacent actual design portions. That is to say, the sequential design can be represented by the data string in the absolute coordinate system as shown in FIG. 5.

The data conversion unit 114 generates the ordinary sewing data that supports multiple cycles with the length in the feeding direction adjusted using the scaling factor thus determined in Step S106, thereby generating a data table as shown in FIG. 5. (Step S107).

Figure 7:
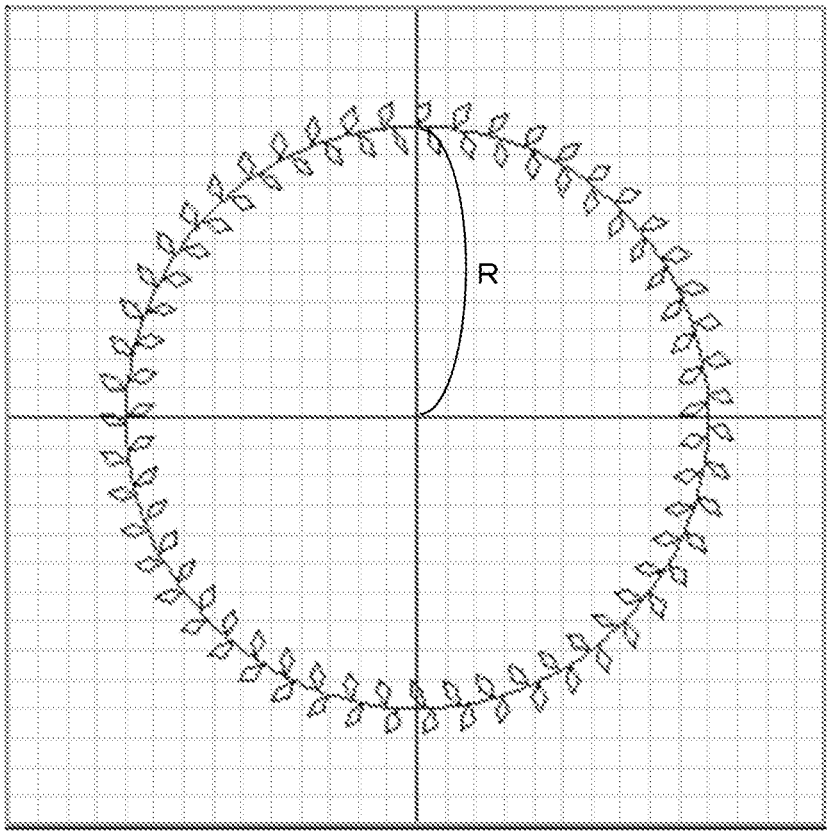
FIG. 7 is a diagram showing an image of circular sewing performed by the embroidery sewing machine according to the first embodiment of the present invention.

Furthermore, the data conversion unit 114 converts the data table as shown in FIG. 5 into coordinate data defined in the X direction and the Y direction in an orthogonal coordinate system via polar coordinate conversion. As a result, the data conversion unit 114 generates a data string having an embroidery data format as shown in FIG. 6 (Step S108). It should be noted that, when the embroidery sewing machine displays a preview on the display apparatus 104 thereof, a design is displayed as shown in FIG. 7.

Subsequently, by driving the embroidery sewing machine 10 according to the embroidery data generated in Step S108, the embroidery sewing machine 10 is capable of sewing a design for the ordinary sewing along the circumference of a circle (Step S109).

It should be noted that description has been made in the present embodiment regarding an example in which the length of the actual design portion or otherwise the length of the actual design junction portion is adjusted with a determined scaling factor. Also, the overall sewing shape, i.e., a desired sewing length, may bP adjusted with the determined scaling factor such that it matches the sewing length calculated based on the number of designs, the length of the actual design portion, and the length of the actual design junction portion.

Description has been made in the present embodiment regarding an arrangement in which one from among the calculated kd, ku, jd, and ju that is closest to "1.0" is selected as the adjustment value. In a case in which the difference between "1.0" and the calculated kd, ku, jd, or otherwise ju is equal to or smaller than a threshold value, the operation in Step S106 may be omitted.

Description has been made in the present embodiment regarding an example in which the length of the actual design portion or otherwise the length of the actual design junction portion is adjusted with a determined scaling factor. Also, both the length of the actual design portion and the length of the actual design junction portion may be adjusted with respective scaling factors obtained by proportionally dividing the determined scaling factor.

As described above, with the present embodiment, the cycle number calculation unit 111 calculates the number of cycles based on the sewing length in the ordinary sewing data, the length of the actual design portion, and the length of the actual design junction portion. When the calculation of the number of cycles performed by the cycle number calculation unit 111 involves a fraction, the adjustment unit 113 adjusts the length of the actual design portion and/or the length of the actual design junction portion according to the fraction. The data conversion unit 114 converts the data of the design length thus adjusted by the adjustment unit 113 into data in an orthogonal coordinate system, thereby generating embroidery data. This provides circular sewing that allows the sewing start point and the sewing end point to match each other.

The adjustment unit 113 calculates the scaling factor kd in a case in which the length of the actual design portion is to be adjusted with the number of cycles N calculated with the rounded-down remainder Nd. Furthermore, the adjustment unit 113 calculates the scaling factor ku in a case in which the length of the actual design portion is to be adjusted with the number of cycles N calculated with the rounded-up remainder Nu. Furthermore, the adjustment unit 113 calculates the scaling factor jd in a case in which the length of the actual design junction portion is to be adjusted with the number of cycles N calculated with the rounded-down remainder Nd. Furthermore, the adjustment unit 113 calculates the scaling factor ju in a case in which the length of the actual design junction portion is to be adjusted with the number of cycles N calculated with the rounded-up remainder Nu. Moreover, the adjustment unit 113 selects one from among the scaling factors kd, ku, jd, and ju that is closest to "1.0", and determines the selected scaling factor as the adjustment value. By setting the degree of adjustment to as low a level as possible, this arrangement allows sewing to be performed such that the sewing start point and the sewing end point match each other without involving deformation of the original sewing image.

In addition, with the present embodiment, this arrangement provides circular sewing without using a circular attachment to be used in ordinary sewing. Thus, this arrangement provides sewing that forms an actual design portion regardless of whether it is positioned inside or outside the circle without involving unnecessary damage to the sewing target.

Second Embodiment

Description will be made with reference to FIGS. 8 through 13 regarding the embroidery sewing machine 10 according to the present embodiment.

It should be noted that the main configuration of the embroidery sewing machine 10 is the same as described in the first embodiment. Accordingly, detailed description thereof will be omitted.

Figure 12A:
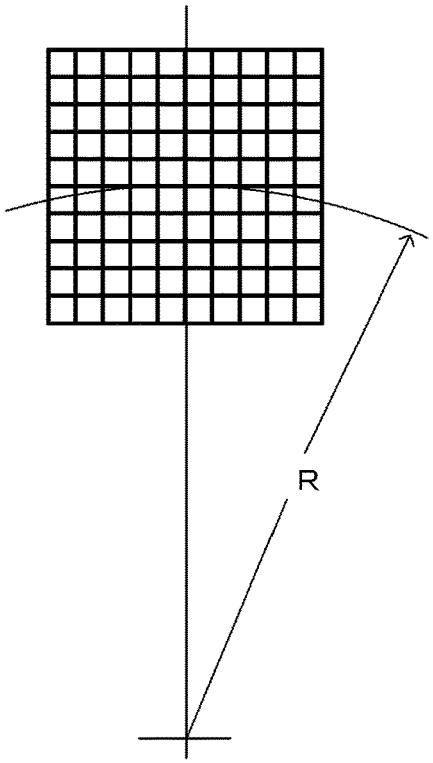
FIGS. 12(A) and 12(B) are diagrams showing an example of conventional designs and designs converted into the polar coordinate system according to the second embodiment.

Description has been made in the first embodiment regrading a method for allowing circular sewing such that the sewing start point and the sewing end point match each other. However, in a case in which the actual design portions are sewn along a curve such as an arc or the like giving consideration to only rotation and movement without giving consideration to shape modification of the actual design portion itself, this leads to deviation of a part of the upper side of the actual design portion outside the corresponding concentric circle and leads to deviation of a part of the lower side of the actual design portion inside the corresponding concentric arc as shown in FIG. 12A, for example. That is to say, such an arrangement has a problem of formation of a design pattern that is largely different from the image of the actual design portions sewn along an arc. Accordingly, as in the first embodiment, description will be made in the present embodiment regarding a method for providing circular sewing with the sewing start point and the sewing end point matching each other. Furthermore, description will be made in the present embodiment regarding such a method for modifying the actual design portion such that the actual design portion is sewn between two concentric arcs defined by the radius of the arc and the height of the design.

[Main Electrical Configuration of Embroidery Sewing Machine]

Figure 8:
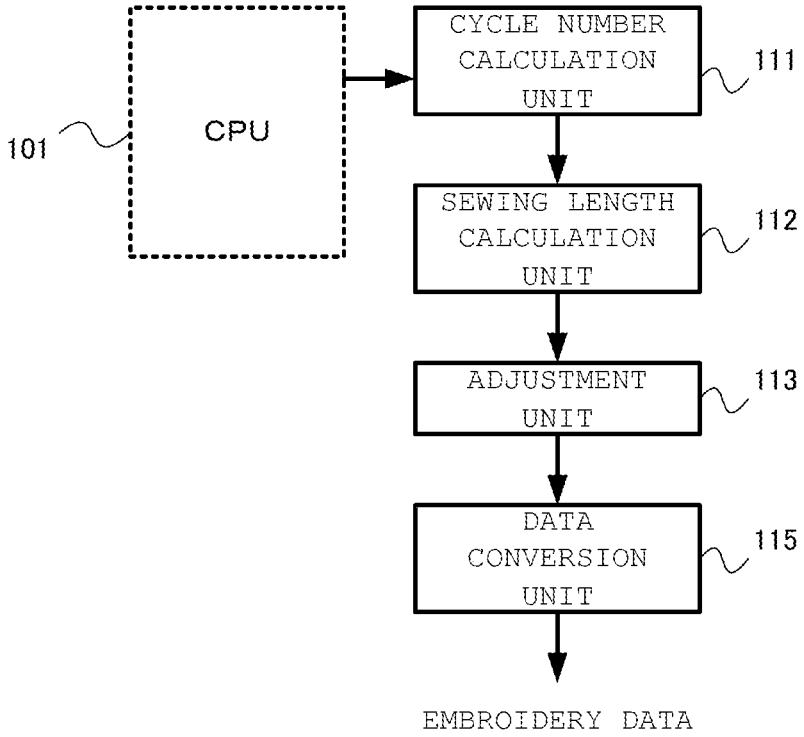

As shown in FIG. 8, the main electrical configuration of the embroidery sewing machine 10 according to the present embodiment comprises a cycle number calculation unit 111, a sewing length calculation unit 112, an adjustment unit 113, and a data conversion unit 115.

The data conversion unit 115 converts the data with respect to the length of the design represented in an absolute coordinate system adjusted by the adjustment unit 113 into polar coordinate data. Subsequently, the data conversion unit 115 converts the polar coordinate data into data represented in an orthogonal coordinate system, thereby generating the embroidery data. The data conversion unit 115 includes a circle information calculation unit and a polar coordinate data generating unit. The circle information calculation unit calculates the radius and the coordinate position of the center of a circle on which three points, i.e., an arbitrary point on a curve along which the designs are arranged and two points before and after the arbitrary point on the same curve, are positioned. The polar coordinate data generating unit generates the polar coordinate data of the design based on the feed amount for the sewing target, the swing amount, the calculated radius, the calculated coordinate position of the center, and the coordinate position of the arbitrary point.

[Operation of Embroidery Sewing Machine]

Figure 9:
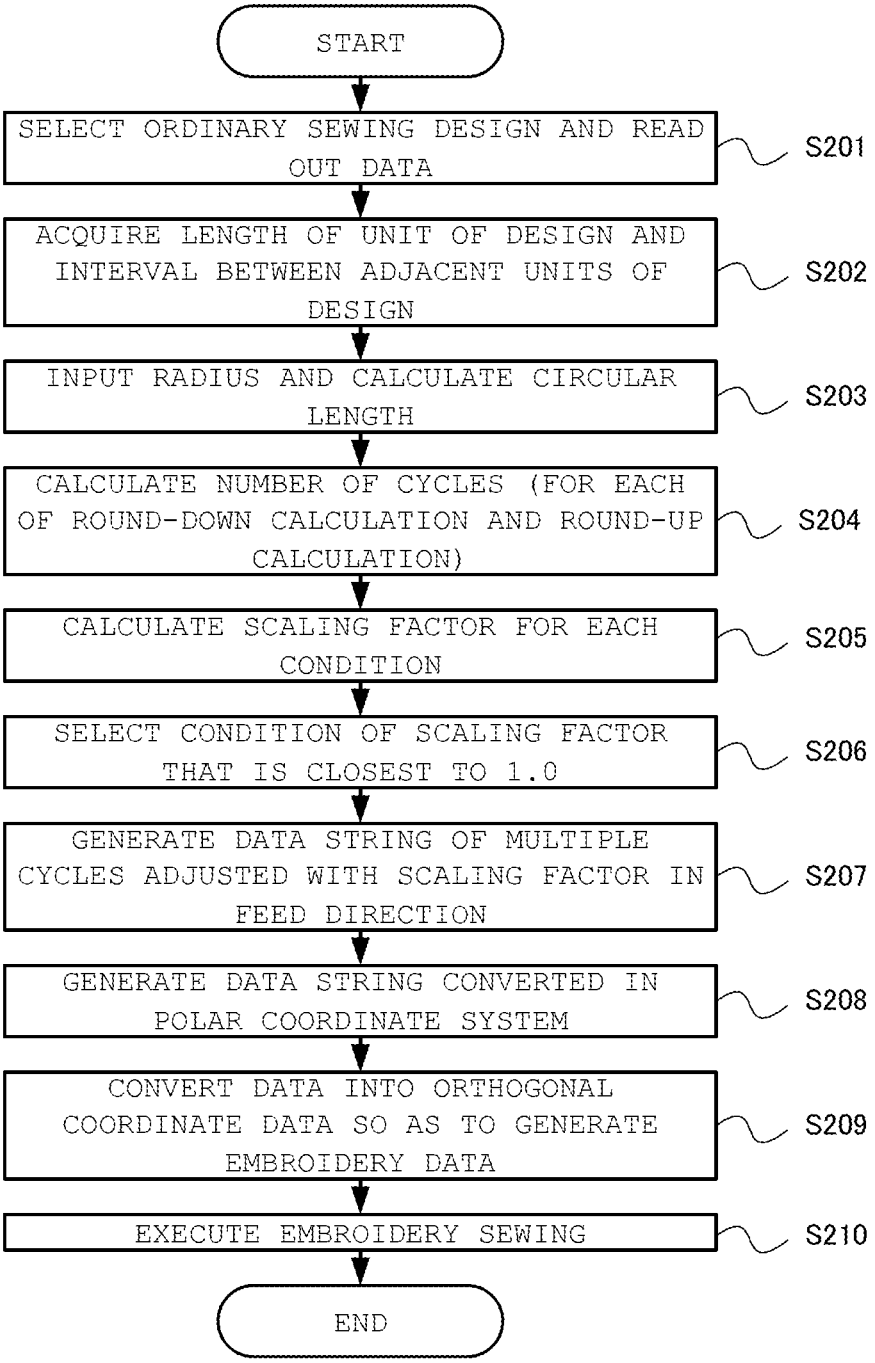
FIG. 9 is a diagram showing an operation of the embroidery sewing machine according to the second embodiment of the present invention.

Description will be made with reference to FIG. 9 regarding the operation of the embroidery sewing machine 10 according to the present embodiment.

First, the CPU 101 instructs the display apparatus 104 to display the design data for ordinary sewing formed of the swing position data and the feed amount data in the form of an icon list that represents the built-in designs. The embroidery sewing machine allows the user to perform touch control via the touch panel 105 to select the design data for desired ordinary sewing from the displayed icon list that represents the built-in designs. The CPU 101 reads out the design data for ordinary sewing thus selected by the user, and stores the design data thus read out in the RAM 103 (Step S201).

It should be noted that, in a case in which the embroidery sewing machine includes a USB drive interface, the embroidery sewing machine may employ a method in which the design data is read out from an external recording medium.

The CPU 101 acquires the length of the actual design portion and the actual design junction portion from the design data for ordinary sewing read out and stored in the RAM 103. The data of the length of the actual design portion and the data of the actual design junction portion thus acquired are output to the cycle number calculation unit 111 (Step S202).

The user inputs the radius of a circular stitch to be used in the circular sewing to a predetermined input box displayed on the touch panel 105. Subsequently, the radius input module stored in the ROM 102 instructs the CPU 101 to calculate the circular length based on the radius of the circular stitch input by the user. The circular length thus calculated is output via the CPU 101 to the cycle number calculation unit 111 and the adjustment unit 113 (Step S203). It should be noted that, in a case in which the circular length of the circular stitch is a known value, the circular length may be stored beforehand in the ROM 102.

The cycle number calculation unit 111 calculates the number of cycles based on the sewing length in the ordinary sewing data that corresponds to the input circular length, the length of the actual design portion, and the length of the actual design junction portion. Specifically, with the radius as R, with the length of the actual design portion as D, and with the length of the actual design junction portion as S, the number of cycles N is calculated based on the following Expression 6. Furthermore, the remainder Nd is calculated when the calculation result is to be rounded down, and the remainder Nu is calculated when the calculation result is to be rounded up (Step S204).

$$N=2\pi R/(D+S) \quad \text{[Expression 1]}$$

The sewing length calculation unit 112 calculates the sewing length based on the number of designs calculated by the cycle number calculation unit 111. The adjustment unit 113 calculates the scaling factor to be used to adjust the sewing length in the ordinary sewing data that corresponds to the circular length such that the sewing length matches a desired length (sewing length in the ordinary sewing data that corresponds to the circular length) (Step S205).

Specifically, the following scaling factors are calculated based on the following Expressions (1) through (4).

(1) A scaling factor kd calculated based on Expression 7 in a case in which the length of the actual design portion is to be adjusted, and with the number of cycles N calculated with the rounded-down remainder Nd.

(2) A scaling factor ku calculated based on Expression 8 in a case in which the length of the actual design portion to be adjusted, and with the number of cycles N calculated with the rounded-up remainder Nu.

(3) A scaling factor id calculated based on Expression in a case in which the length of the actual design junction portion is to be adjusted, and with the number of cycles N calculated with the rounded-down remainder Nd.

(4) A scaling factor ju calculated based on Expression in a case in which the length of the actual design junction portion is to be adjusted, and with the number of cycles N calculated with the rounded-up remainder Nu.

$$kd=(2\pi R-S*Nd)/(D*Nd) \quad \text{[Expression 7]}$$

$$ku=(2\pi R-S*Nu)/(D*Nu) \quad \text{[Expression 8]}$$

$$jd=(2\pi R-D*Nd)/(S*Nd) \quad \text{[Expression 9]}$$

$$ju=(2\pi R-D*Nu)/(S*Nu) \quad \text{[Expression 10]}$$

The adjustment unit 113 selects one from among kd, jd, and ju calculated in Step S205 that is closest to "1.0", and determines the selected value as an adjustment value (Step S206). It should be noted that, in a case of using a rounded-down number of cycles, the scaling factor is set to a value that is larger than "1.0", i.e., set to a scaling factor for enlargement. In a case of using a rounded-up number of cycles, the scaling factor is set to a value that is smaller than "1.0", i.e., set to a scaling factor for reduction.

Here, as shown in FIG. 4, with the center in the swing direction as zero, the ordinary sewing data is formed of: swing position data that represents the swinging operation of the needle rod over a range between a leftmost position shifted by up to 4.5 mm toward the left and a rightmost position shifted by up to 4.5 mm toward the right, i.e., over a range between −4.5 mm and ±4.5 mm; and relative feed data that represents the feeding operation of the feed dog over a region between −5 mm and 5 mm in which the sewing target is fed by up to 5 mm in the advancing direction or otherwise fed by up to 5 mm in the reversing direction. In this arrangement, the sewing target is moved for every stitch in the feed direction, thereby forming the actual design portion having a design length on the order of several dozen mm. The actual design portion is repeatedly and sequentially sewn, thereby providing a large-length design having multiple cycles. The sequential design can be represented by accumulating the feed data that represents the relative distance, and by further applying a space (length of the actual design junction portion) between the adjacent actual design portions. That is to say, the sequential design can be represented by the data string in the absolute coordinate system as shown in FIG. 5.

The data conversion unit 115 generates the ordinary sewing data that supports multiple cycles with the length in the feeding direction adjusted using the scaling factor thus determined in Step S206, thereby generating a data table as shown in FIG. 5. (Step S207).

Figure 11:
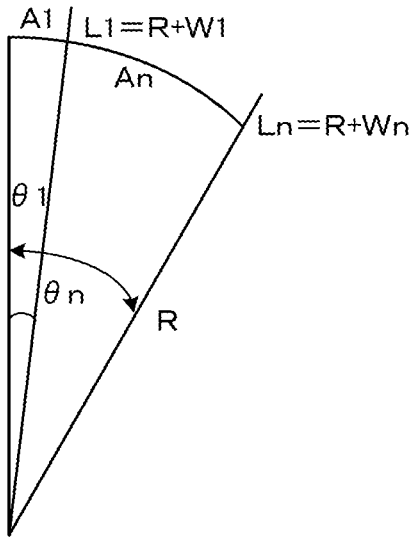
FIG. 11 is a schematic diagram showing conversion into the polar coordinate data according to the second embodiment of the present invention.

Furthermore, the data conversion unit 115 generates the polar coordinate data table as shown in FIG. 10 based on the data table generated in Step S207 (Step S208). Specifically, as shown in FIG. 11, with the radius as R, and with the feed amount on the circle for every stitch as An, the angle θn with which the cloth is rotated is represented by Expression 11.

$$\theta_n = A_n / R \text{ [rad]} \quad \text{[Expression 11]}$$

In this stage, the swing provides a shift in position Wn from the center of swing, defined based on the radius R. Accordingly, Ln is represented by Expression 12.

$$L_n = R + W_n \text{ [mm]} \quad \text{[Expression 12]}$$

In a case in which the aforementioned data is represented in a polar coordinate system (using Euler's formula), the data is represented by the following Expression 13.

$$L_n \cdot e^{i\theta_n} \quad \text{[Expression 13]}$$

As described above, the data is converted to the polar coordinate system for every stitch, and combinations of the length and the polar angle are sequentially arranged in the form of a table, which is shown in FIG. 10 (Step S208). As a result of this data processing, each needle location point for the design is positioned on the corresponding circumference of a circle.

In this arrangement, the embroidery sewing machine 10 drives an embroidery frame in the X direction and the Y direction so as to perform positioning of each needle location point, thereby sewing a design. Accordingly, the polar coordinate data to be arranged along the corresponding circumference of a circle is subjected to data conversion to an orthogonal coordinate system using Expression 14. As a result, the data table shown in FIG. 10 is converted into a data table in the orthogonal coordinate system as shown in FIG. 6 (Step S209).

$$x = L^* \cos(-\theta)$$

$$y = L^* \sin(-\theta) \quad \text{[Expression 14]}$$

It should be noted that these Expressions each represent conversion in the clockwise direction from the zero-angle position. Accordingly, in these Expressions, the sign of the polar angle is inverted.

By performing the aforementioned processing, the data table represented in the polar coordinate system shown in FIG. 10 is converted into the coordinate data in the orthogonal system defined by the X direction and the Y direction. Furthermore, the relative amount of movement is calculated for each of the X direction and the Y direction, thereby generating the data string in the embroidery data format as shown in FIG. 6. It should be noted that, when the embroidery data thus generated is displayed on the display apparatus 104 in a preview format, a design is displayed as shown in FIG. 7.

With such an arrangement, by driving the embroidery sewing machine 10 according to the embroidery data generated in Step S209, a design for ordinary sewing can be sewn along a circle (Step S210).

It should be noted that description has been made in the present embodiment regarding an example in which the design has an overall shape of a single circle, and the radius of the single circle is set by the user. Also, the present embodiment supports sewing of a design having an overall shape of a single circle having an unknown radius. Also, the present embodiment supports sewing of a design having an overall shape of a combination of multiple different arcs.

Figure 13A:
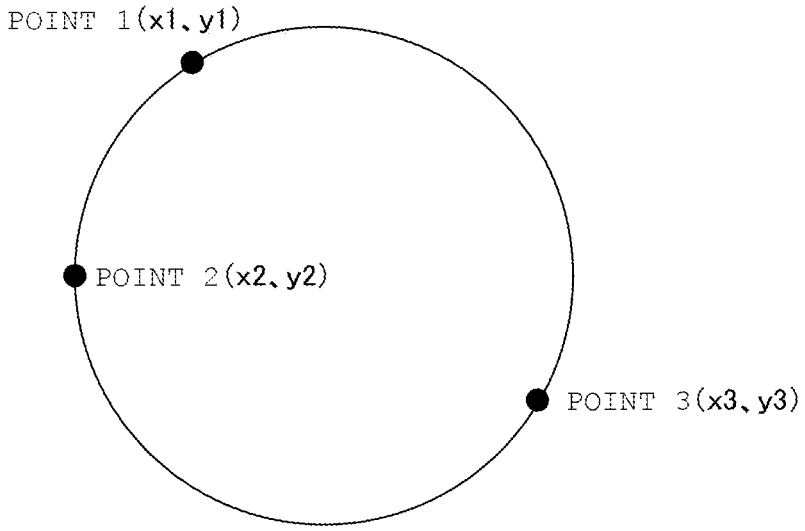
FIGS. 13(A) and 13(B) are diagrams showing a mechanism for calculating the radius based on three points according to the second embodiment of the present invention.
Figure 13B:
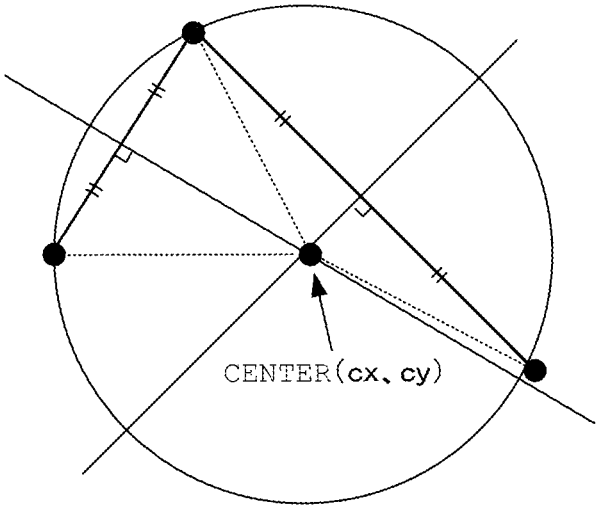

That is to say, in a case of sewing a design having an overall shape of a single circle having an unknown radius or having an overall shape of a combination of multiple different arcs, in order to calculate the radius of each arc, as shown in FIG. 13, a circle is extracted such that it passes through three points, i.e., a point 1 (x1, y1), a point 2 (x2, y2), and a point 3 (x3, y3) (excluding a case in which the three points are positioned along the same straight line). Next, as shown in FIG. 13B, using these three points, two straight lines are each defined as a straight line between two points from among the three points. Furthermore, a perpendicular bisector is defined for each of the two straight lines. The point of intersection between the two perpendicular bisectors thus defined is defined as the center of the circle. Furthermore, the radius of the circle can be acquired as the length of a line between the center of the circle thus defined and one from among the aforementioned three points. With such an arrangement, in a case in which the feed amount and the swing amount are known in the sewing, this arrangement is capable of generating the polar coordinate data of a design based on the coordinate position of a given point, the calculated radius of the corresponding circle, and the coordinate position of the center of the corresponding circle even in a case of sewing a design having an overall shape of a single circle having an unknown radius or having an overall shape of a combination of multiple different arcs.

As described above, with the present embodiment, the cycle number calculation unit 111 calculates the number of cycles based on the sewing length in the ordinary sewing data, the length of the actual design portion, and the length of the actual design junction portion. When the calculation of the number of cycles performed by the cycle number calculation unit 111 involves a fraction, the adjustment unit 113 adjusts the length of the actual design portion and/or the length of the actual design junction portion according to the fraction. The data conversion unit 115 converts the data of the design length thus adjusted by the adjustment unit 113 into data in an orthogonal coordinate system, thereby generating embroidery data. This provides circular sewing that allows the sewing start point and the sewing end point to match each other.

Figure 12B:
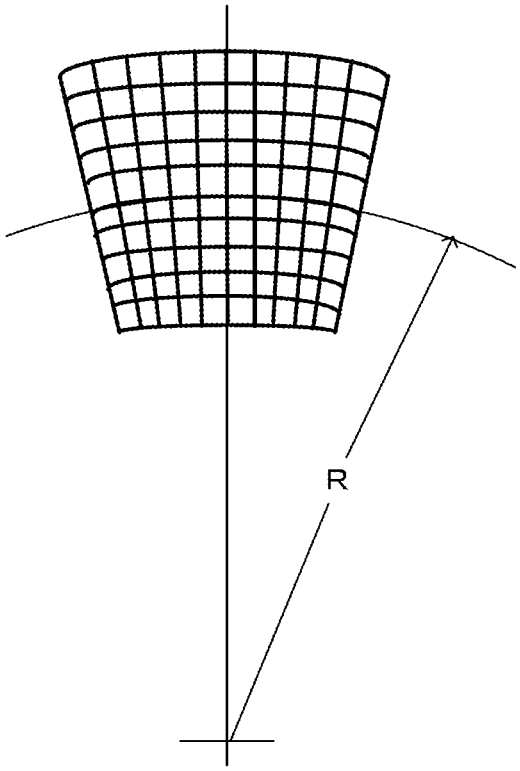

Furthermore, with the present embodiment, as shown in FIG. 12B, this arrangement is capable of providing sewing according to the user's image not only in a case of sewing an overall shape of a single circle, but also even in a case of sewing a design having an overall shape of a combination of multiple different arcs.

Third Embodiment

Description will be made with reference to FIGS. 14 through 17 regarding the embroidery sewing machine 10 according to the present embodiment. It should be noted that the configuration of the embroidery sewing machine 10 is the same as that described in the first embodiment, and accordingly, detailed description thereof will be omitted.

Description has been made in the first embodiment regarding circular sewing, i.e., sewing of multiple designs arranged on a circle. Also, even in a case of sewing such multiple designs along an outline formed of a combination of curves and lines as shown in FIG. 14, by applying the processing described in the first embodiment to such a sewing operation, this arrangement is capable of supporting such sewing.

Figure 14:
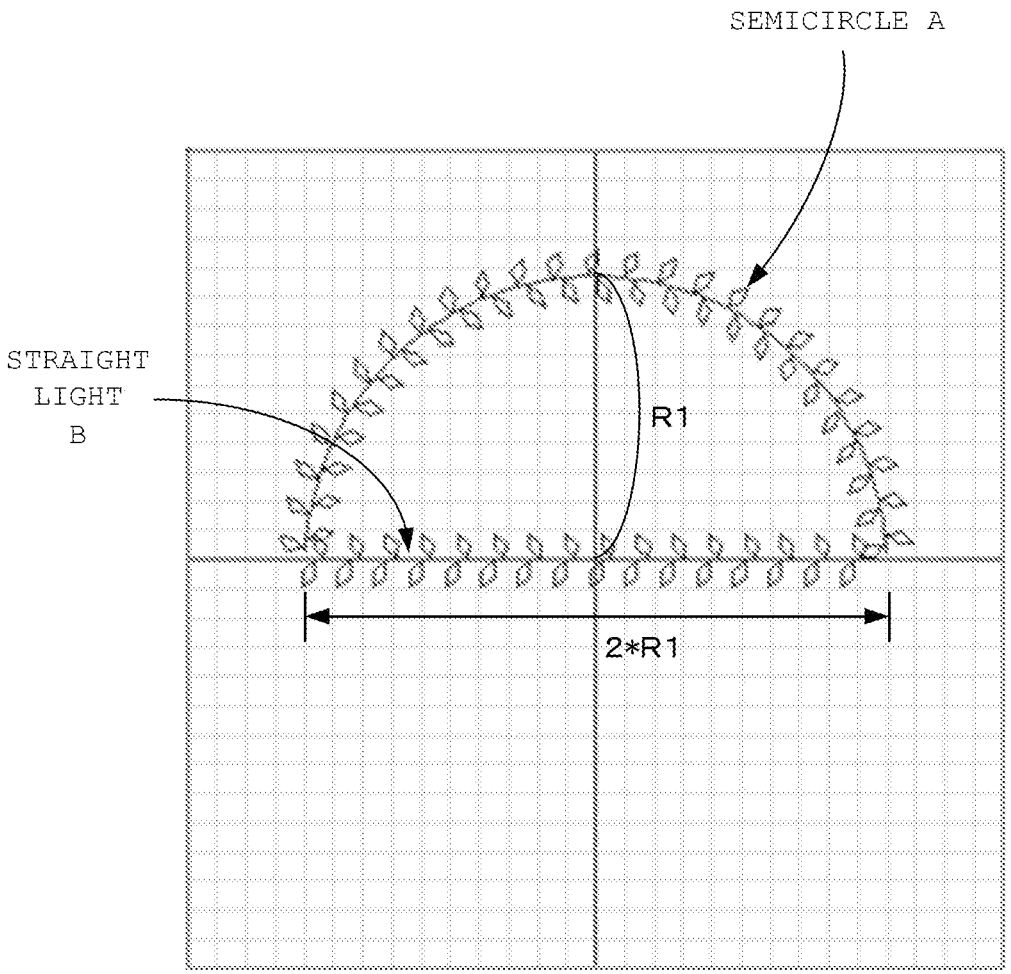
FIG. 14 is a diagram showing an image of an outline configured as a combination of an arc and a straight line sewn by an embroidery sewing machine according to a third embodiment of the present invention.
Figure 17:
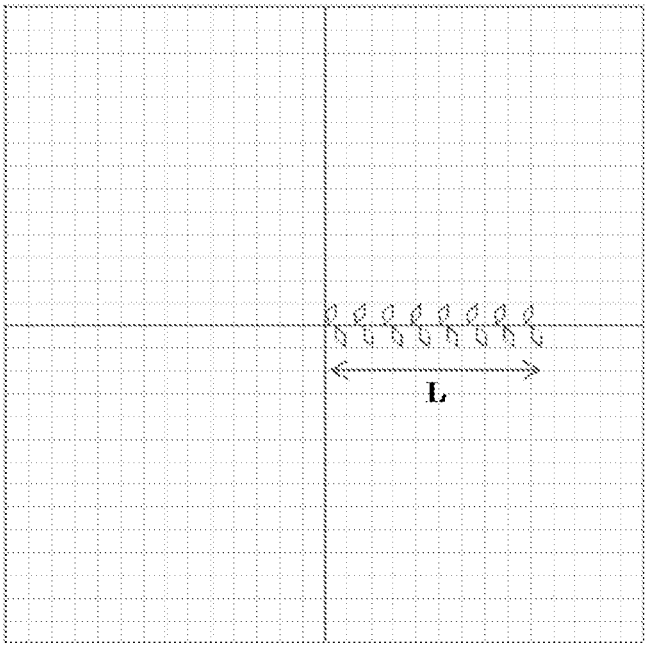
FIG. 17 is a diagram showing an image of sewing in a straight-line direction sewn by the embroidery sewing machine according to the third embodiment of the present invention.

As shown in FIG. 14, such an outline is formed of a combination of a semicircle A and a straight line B. With such an arrangement, the same operation as described in the first embodiment is performed for each of the semicircle A and the straight line B.

Specifically, in the operation for the semicircle A, the CPU 101 acquires the length of the actual design portion and the length of the actual design junction portion from the design data for ordinary sewing read out and stored in the RAM 103. Furthermore, the CPU 101 outputs the length of the actual design portion and the length of the actual design junction portion thus acquired to the cycle number calculation unit 111.

The user inputs the radius R1 of the semicircle A via the touch panel 105. Subsequently, the radius input module stored in the ROM 102 instructs the CPU 101 to calculate the length of the arc π*R1 of the semicircle A based on the radius R1 input by the user, and to output the length of the arc thus calculated to the cycle number calculation unit 111.

The cycle number calculation unit 111 calculates the number of cycles based on the sewing length in the ordinary sewing data that corresponds to the length of the arc thus input, the length of the actual design portion, and the actual design junction portion.

The sewing length calculation unit 112 calculates the sewing length based on the number of designs calculated by the cycle number calculation unit 111.

The adjustment unit 113 calculates the scaling factor to be used to adjust the sewing length in the ordinary sewing data such that the sewing length matches a desired length (sewing length in the ordinary sewing data that corresponds to the length of the arc).

Specifically, the following scaling factors are calculated based on the following Expressions (1) through (4).

(1) A scaling factor kd calculated in a case in which the length of the actual design portion is to be adjusted, and with the number of cycles N calculated with the rounded-down remainder Nd.

(2) A scaling factor ku calculated in a case in which the length of the actual design portion is to be adjusted, and with the number of cycles N calculated with the rounded-up remainder Nu.

(3) A scaling factor jd calculated in a case in which the length of the actual design junction portion is to be adjusted, and with the number of cycles N calculated with the rounded-down remainder Nd.

(4) A scaling factor ju calculated in a case in which the length of the actual design junction portion is to be adjusted, and with the number of cycles N calculated with the rounded-up remainder Nu.

The adjustment unit 113 selects one from among kd, ku, jd, and ju thus calculated that is closest to "1.0", and determines the selected value as an adjustment value.

The data conversion unit 114 generates the ordinary sewing data of multiple cycles such that the length in the feed direction is adjusted using the scaling factor thus determined, thereby generating the data table as shown in FIG. 5. Furthermore, the data conversion unit 114 converts the data table as shown in FIG. 5 into coordinate data in the orthogonal coordinate system defined in the X direction and the Y direction. Furthermore, the relative amount of movement is calculated for each of the X direction and the Y direction, thereby generating a data string in the embroidery data format as shown in FIG. 6.

On the other hand, in the operation for the straight line B, specifically, the CPU 101 acquires the length of the actual design portion and the length of the actual design junction portion from the design data for ordinary sewing read out and stored in the RAM 103. Furthermore, the CPU 101 outputs the length of the actual design portion and the length of the actual design junction portion thus acquired to the cycle number calculation unit 111.

The user inputs the radius R1 of the semicircle A via the touch panel 105. Subsequently, the radius input module stored in the ROM 102 instructs the CPU 101 to calculate the length of the straight line B, i.e., 2*R1 based on the radius R1 input by the user, and to output the length of the straight line thus calculated to the cycle number calculation unit 111.

The cycle number calculation unit 111 calculates the number of cycles based on the sewing length in the ordinary sewing data that corresponds to the length of the straight line thus input, the length of the actual design portion, and the actual design junction portion.

The sewing length calculation unit 112 calculates the sewing length based on the number of designs calculated by the cycle number calculation unit 111.

The adjustment unit 113 calculates the scaling factor to be used to adjust the sewing length in the ordinary sewing data such that the sewing length matches a desired length (sewing length in the ordinary sewing data that corresponds to the length of the straight line).

Specifically, the following scaling factors are calculated based on the following Expressions (1) through (4).

(1) A scaling factor kd calculated in a case in which the length of the actual design portion is to be adjusted, and with the number of cycles N calculated with the rounded-down remainder Nd.

(2) A scaling factor ku calculated in a case in which the length of the actual design portion is to be adjusted, and with the number of cycles N calculated with the rounded-up remainder Nu.

(3) A scaling factor jd calculated in a case in which the length of the actual design junction portion is to be adjusted, and with the number of cycles N calculated with the rounded-down remainder Nd.

(4) A scaling factor ju calculated in a case in which the length of the actual design junction portion is to be adjusted, and with the number of cycles N calculated with the rounded-up remainder Nu.

The adjustment unit 113 selects one from among kd, ku, jd, and ju thus calculated that is closest to "1.0", and determines the selected value as an adjustment value.

The data conversion unit 114 generates the ordinary sewing data of multiple cycles such that the length in the feed direction is adjusted using the scaling factor thus determined, thereby generating the data table as shown in FIG. 15. Furthermore, the data conversion unit 114 converts the data table as shown in FIG. 15 into coordinate data in the orthogonal coordinate system defined in the X direction and the Y direction. Furthermore, the relative amount of movement is calculated for each of the X direction and the Y direction, thereby generating a data string in the embroidery data format as shown in FIG. 16. By forming embroidery along the straight line B by means of the embroidery sewing machine 10, this arrangement provides a design like the image shown in FIG. 17.

When the embroidery data thus generated as described above is displayed on the display apparatus 104 in a preview format, a design is displayed as shown in FIG. 14. It should be noted that description has been made regarding the operation with the adjustment value having as small a value as possible. In a case of performing sewing along such an outline described in the present embodiment, the adjustment is preferably performed such that the start point along the semicircle A matches the start of the actual design portion and the end point along the semicircle A matches the end of the actual design portion, the start point along the straight line B matches the start of the actual design portion, and the end point along the straight light B matches the end of the actual design portion. This arrangement is preferably made from the viewpoint of the overall appearance of the design.

Description has been made in the present embodiment regarding an arrangement in which sewing is performed along a combination of curves and lines. Also, the present invention is applicable to sewing along a polygon or the like formed of multiple lines.

As described above, with the present embodiment, sewing can be performed along a combination of a semicircle and a straight line with matching of the junction between the semicircle and the straight line. Furthermore, this arrangement selects one from among the calculated scaling factors such that it is closest to "1.0", and determines the scaling factor thus selected as the adjustment value. Thus, this arrangement is capable of providing sewing such that the sewing start point matches the sewing end point with as small a degree of adjustment as possible. This provides sewing without deformation of the original sewing image.

Also, by providing the configuration described in the second embodiment, this arrangement provides sewing for the semicircle A according to the user's image of the design as shown in FIG. 12B.

[Modification]

Description will be made with reference to FIGS. 18 and 19 regarding the embroidery sewing machine 10 according to the present modification.

It should be noted that the configuration of the embroidery sewing machine 10 is the same as that described in the first embodiment, and accordingly, detailed description thereof will be omitted.

Description has been made in the first embodiment regarding an arrangement in which, in a case of performing circular sewing, i.e., performing sewing of multiple designs arranged on a circle, the sewing is performed such that the start point and the end point along a circle match each other. Description has been made in the third embodiment regarding an arrangement in which, in a case of performing sewing along a combination of a curve and a line as shown in FIG. 14, the sewing is performed such that the end point of the curve matches the end point of the straight line.

Description will be made in the present modification regarding an arrangement in which sewing is performed along a combination of two curves. In the present modification, the operation according to the first embodiment is applied to a method in which the combination of two curves is handled as a single curve so as to provide continuity in the overall length of the combination of two curves, thereby providing matching of the end points between the two curves.

As ordinary sewing techniques, a circular sewing method in which sewing is performed along a circular outline using the aforementioned circular attachment, and a ruler work method in which sewing is performed so as to provide linear stitches along a ruler having a desired shape, are known. In the ruler work method, a foot is pressed in contact with the ruler, and sewing is performed while sliding the sewing position along the ruler, thereby forming stitches along a curve or a wave-shaped outline.

In this sewing method, by the user pressing the needle into contact with the ruler, this arrangement shifts the sewing target in the swing direction. Furthermore, the sewing target is fed in the feed direction by means of the feed dog of the sewing machine. However, in order to maintain the swing position in a direction that is orthogonal to an arc, this arrangement requires the user to operate while paying attention to the angle of the ruler. Accordingly, it is difficult for the user to manually operate the sewing machine, which is a problem. As a result, such an arrangement is not capable of providing stitches along a curve or a wave-shaped outline according to the user's image. Furthermore, with such an arrangement, the operation is performed in a state in which the user presses the needle into contact with the ruler. Accordingly, the operation is limited to a range between the outer edge of the ruler and the needle. Such an arrangement is capable of sewing a design in only a range outside the ruler, which is a problem.

The present modification provides stitches in the form of a curve or a wave-shaped outline as intended by the user using the technique described in the first embodiment.

Figure 18:
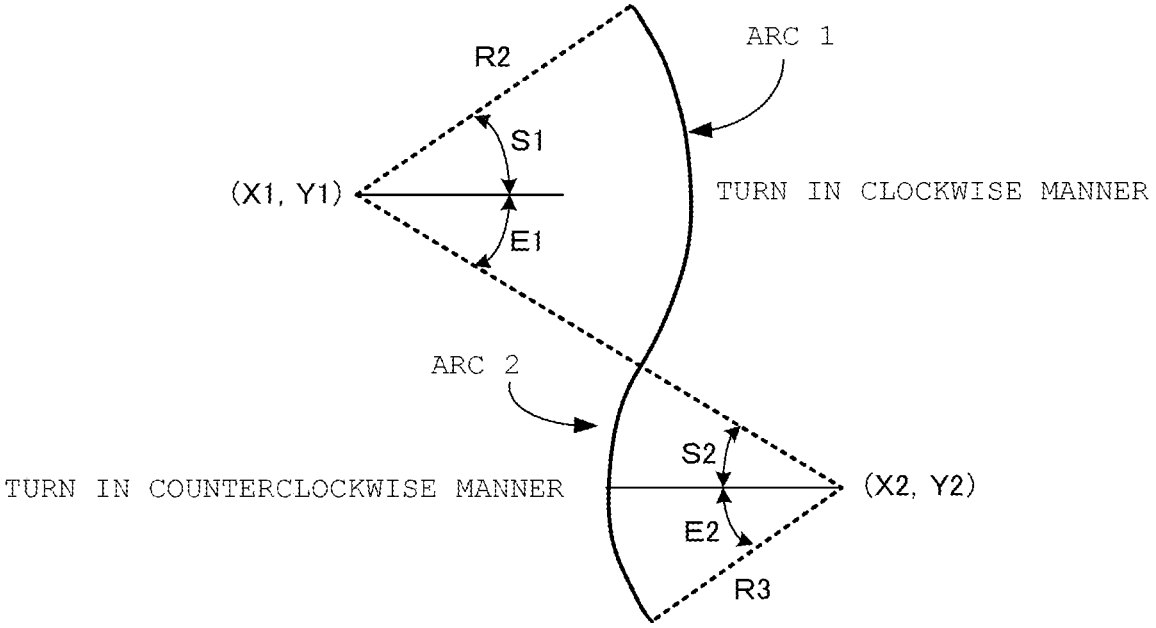
FIG. 18 is a diagram showing parameters to be used to sew a wave-shaped design according to a modification of the present invention.
Figure 19:
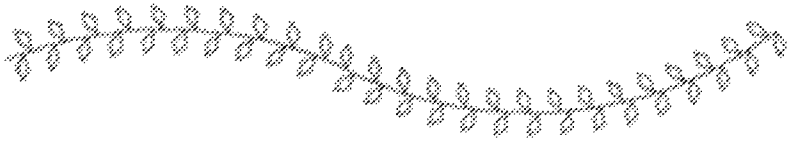
FIG. 19 is a diagram showing an image of a wave-shaped design sewn by the embroidery sewing machine according to the modification of the present invention.

In a case in which the user's desired stitch outline such as a curved stitch outline or a wave-shaped stitch outline is as shown in FIG. 18, the arc length of the arc 1 and the arc length of the arc 2 are calculated based on the radius R2 and the central angle of the arc 1 and the radius R3 and the central angle of the arc 2. By making the sum total of the arc length of the arc 1 and the arc length of the arc 2 thus calculated, the sewing length (desired sewing length) is calculated. The operation according to the first embodiment is applied to the sewing length thus calculated, thereby generating a data string in the embroidery data format as shown in FIG. 6 for the stitch outline as intended by the user as shown in FIG. 18.

Accordingly, by performing a sewing operation based on the data thus generated, this arrangement is capable of forming stitches in the form of a curve or a wave-shaped outline as intended by the user. It should be noted that the method described in the first embodiment allows sewing with as small a degree of adjustment as possible. This provides sewing without departing from the original sewing image. In a case of providing such a stitch outline as shown in FIG. 18, adjustment is preferably made such that the point of intersection between the end point of the arc 1 and the start point of the arc 2 matches the center of the actual design portion as shown in FIG. 19 from the viewpoint of improved overall appearance of the design.

It should be noted that, by providing the configuration described in the second embodiment, this modification is capable of performing sewing of stitches in the form of a curve or a wave-shaped outline according to the user's image as shown in FIG. 12B.

It should be noted that the operation of the embroidery sewing machine may be recorded on a computer-system-readable or computer-readable recording medium in the form of a program. Also, such a program thus recorded on the recording medium may be read out and executed by the embroidery sewing machine, thereby providing the embroidery sewing machine according to the present invention. Examples of such a computer system or computer as used here include an OS and a hardware component such as peripheral devices or the like.

Also, the "computer system" or "computer" encompasses website providing environments (or display environments) that employ the WWW (World Wide Web) system. Also, the aforementioned program may be transmitted to other computer systems or computers from a given computer system or computer that stores this program in its storage apparatus or the like via a transmission medium or otherwise transmission waves in the transmission medium. The "transmission medium" as used here to transmit a program represents a medium having a function of transmitting information, examples of which include networks (communication networks) such as the Internet and communication lines (communication wires) such as phone lines, etc.

Also, the aforementioned program may be configured to provide a part of the aforementioned function. Also, the aforementioned program may be configured as a so-called differential file (differential program), which is to be combined with a different program stored beforehand in a computer system or a computer in order to provide the aforementioned function.

Detailed description has been made with reference to the drawings regarding the embodiments of the present invention. However, such a specific configuration is not restricted to the embodiments. Rather, various kinds of changes in design or the like may be made without departing from the scope of the present invention.

DESCRIPTION OF THE REFERENCE NUMERALS

10 embroidery sewing machine, 101 central processing unit (CPU), 102 ROM, 103 RAM, 104 display apparatus, 105 touch panel, 106 tactile switch, 107 sewing machine motor control apparatus, 108 swing/feed motor control apparatus, 109 X-Y control motor apparatus, 111 cycle number calculation unit, 112 sewing length calculation unit, 113 adjustment unit, 114 data conversion unit, 115 data conversion unit.

What is claimed is:

1. An embroidery sewing machine configured to perform sewing of designs arranged for a prescribed sewing length, the embroidery sewing machine comprising:

a storage unit that stores the prescribed sewing length and information with respect to the designs;

a cycle number calculation unit that calculates a number of designs to be used for sewing for a length that is closest to the prescribed sewing length, based on the prescribed sewing length and the information with respect to the designs;

a sewing length calculation unit that calculates a sewing length based on the number of the designs calculated by the cycle number calculation unit and the information with respect to the designs;

an adjustment unit that adjusts the length of the designs such that the prescribed sewing length matches the calculated sewing length; and a data conversion unit that converts data of the designs that support the sewing length thus adjusted into embroidery data, wherein the calculated sewing length is calculated as a length of an entirety of the designs for a single embroidery pattern made of the embroidery data.

2. The embroidery sewing machine according to claim 1, wherein each of the designs is formed of an actual design portion having a predetermined shape and an actual design junction portion that joins adjacent actual design portions, arranged in a region defined in a length direction and a width direction that is orthogonal to the length direction, and wherein the adjustment unit adjusts one from among or otherwise both of a length of the actual design portion and a length of the actual design junction portion.

3. The embroidery sewing machine according to claim 2, wherein, in a case of adjusting the length of the actual design portion, the adjustment unit subtracts a length of the actual design junction portions that corresponds to the number of the designs thus calculated from the prescribed sewing length, wherein the adjustment unit divides the length thus subjected to the subtraction by a value obtained by multiplying the number of designs thus calculated by the length of the actual design portion, so as to calculate a scaling factor to be applied to the length of the actual design portion, and wherein the adjustment unit adjusts the length of the actual design portion using the scaling factor thus calculated.

4. The embroidery sewing machine according to claim 2, wherein, in a case of adjusting the length of the actual design junction portion, the adjustment unit subtracts a length of the actual design portions that corresponds to the number of the designs thus calculated from the prescribed sewing length, wherein the adjustment unit divides the length thus subjected to the subtraction by a value obtained by multiplying the number of designs thus calculated by the length of the actual design junction portion, so as to calculate a scaling factor to be applied to the length of the actual design junction portion, and wherein the adjustment unit adjusts the length of the actual design junction portion using the scaling factor thus calculated.

5. The embroidery sewing machine according to claim 2, wherein the adjustment unit subtracts a length of the actual design junction portions that corresponds to the number of the designs thus calculated from the prescribed sewing length, wherein the adjustment unit divides the length thus subjected to the subtraction by a value obtained by multiplying the number of designs thus calculated by the length of the actual design portion, so as to calculate a scaling factor to be applied to the length of the actual design portion, wherein the adjustment unit subtracts a length of the actual design portions that corresponds to the number of the designs thus calculated from the prescribed sewing length, wherein the adjustment unit divides the length thus subjected to the subtraction by a value obtained by multiplying the number of designs thus calculated by the length of the actual design junction portion, so as to calculate a scaling factor to be applied to the length of the actual design junction portion, and wherein the adjustment unit selects, from among the scaling factor for the length of the actual design portion and the scaling factor for the length of the actual design junction portion, a scaling factor that is closer to 1, and performs adjustment based on the selected scaling factor.

6. The embroidery sewing machine according to claim 2, wherein the adjustment unit calculates an adjustment scaling factor to be used for sewing of the designs arranged for a prescribed sewing length, in order to perform adjustment such that the prescribed sewing length matches the sewing length thus calculated based on the length of the actual design portion and the length of the actual design junction portion.

7. The embroidery sewing machine according to claim 1, wherein, in a case in which the designs are arranged along a curve, the data conversion unit converts the data of the designs thus adjusted into polar coordinate data, following which the data conversion unit converts the polar coordinate data into the embroidery data.

8. The embroidery sewing machine according to claim 7, wherein the data conversion unit comprises:

a circle information calculation unit that calculates a radius and a coordinate position of a center of a circle defined such that three points, including an arbitrary point along the curve on which the designs are arranged and two points before and after the arbitrary point, are on the circumference thereof; and a polar coordinate data generating unit that generates the polar coordinate data based on a feed amount and a swing amount in sewing, the radius and the coordinate position of the center thus calculated, and the coordinate position of the arbitrary point.

9. The embroidery sewing machine according to claim 1, wherein, the designs are arranged on a circle.

10. The embroidery sewing machine according to claim 1, wherein, the prescribed sewing length is defined as a prescribed entire length of a plurality of straight line segments in a seam along which the designs are arranged.

11. The embroidery sewing machine according to claim 1, wherein, the prescribed sewing length is defined as a prescribed entire length of a plurality of straight line segments and curved line segments in a seam along which the designs are arranged.

12. The embroidery sewing machine according to claim 1, wherein, the prescribed sewing length is defined as a prescribed entire length of a plurality of curved line segments in a seam length along which the designs are arranged.

13. A sewing method employed in an embroidery sewing machine comprising a storage unit, a cycle number calculation unit, a sewing length calculation unit, an adjustment unit, and a data conversion unit, and configured to perform sewing of designs arranged for a prescribed sewing length, the sewing method comprising:

a first step in which the cycle number calculation unit calculates a number of the designs to be used for sewing for a length that is closest to the prescribed sewing length, based on information with respect to the sewing of the prescribed sewing length and the information with respect to the designs stored in the storage unit;

a second step in which the sewing length calculation unit calculates a sewing length based on the number of the designs calculated in the first step and the information with respect to the designs;

a third step in which the adjustment unit adjusts the length of the designs such that the prescribed sewing length matches the calculated sewing length; and a fourth step in which the data conversion unit converts data of the designs that support the sewing length thus adjusted into embroidery data, wherein the calculated sewing length is calculated as a length of an entirety of the designs for a single embroidery pattern made of the embroidery data.

14. A non-transitory recording medium that stores a program to be used to instruct a computer to execute a sewing method employed in an embroidery sewing machine comprising a storage unit, a cycle number calculation unit, a sewing length calculation unit, an adjustment unit, and a data conversion unit, and configured to perform sewing of designs arranged for a prescribed sewing length, the sewing method comprising:

a first step in which the cycle number calculation unit calculates a number of the designs to be used for sewing for a length that is closest to the prescribed sewing length, based on information with respect to the sewing of the prescribed sewing length and the information with respect to the designs stored in the storage unit;

a second step in which the sewing length calculation unit calculates a sewing length based on the number of the designs calculated in the first step and the information with respect to the designs;

a third step in which the adjustment unit adjusts the length of the designs such that the prescribed sewing length matches the calculated sewing length; and a fourth step in which the data conversion unit converts data of the designs that support the sewing length thus adjusted into embroidery data, wherein the calculated sewing length is calculated as a length of an entirety of the designs for a single embroidery pattern made of the embroidery data.

* * * * *